US006565741B2

(12) United States Patent
Wismann et al.

(10) Patent No.: US 6,565,741 B2
(45) Date of Patent: May 20, 2003

(54) PROCESS FOR DESULFURIZATION OF PETROLEUM DISTILLATES

(76) Inventors: William Wismann, 5166 Cortevistora, Camarillo, CA (US) 93012; Santosh K. Gangwal, 105 S. Coslett Ct., Cary, NC (US) 27513

( * ) Notice: Subject to any disclaimer, the term of this patent is extended or adjusted under 35 U.S.C. 154(b) by 0 days.

(21) Appl. No.: 09/735,839

(22) Filed: Dec. 13, 2000

(65) Prior Publication Data

US 2002/0043482 A1 Apr. 18, 2002

Related U.S. Application Data

(60) Provisional application No. 60/170,416, filed on Dec. 13, 1999.

(51) Int. Cl.[7] ..... C10G 25/00; C10G 25/12; C10G 27/00

(52) U.S. Cl. ..... 208/208 R; 208/196; 208/218; 208/305; 208/307; 502/30

(58) Field of Search ..... 208/196, 208 R, 208/218, 305, 307; 502/30

(56) References Cited

U.S. PATENT DOCUMENTS

| | | | | |
|---|---|---|---|---|
| 1,998,863 A | | 4/1935 | Chaney et al. | |
| 2,324,927 A | | 7/1943 | Heilman | |
| 2,733,190 A | * | 1/1956 | Noble | 208/196 |
| 2,877,176 A | | 3/1959 | Wolff et al. | |
| 2,966,453 A | | 12/1960 | Gleim et al. | |
| 3,413,307 A | * | 11/1968 | Heimlich et al. | 208/196 |
| 3,440,164 A | * | 4/1969 | Aldridge | 208/216 R |
| 3,551,328 A | * | 12/1970 | Cole et al. | 208/196 |
| 3,725,299 A | * | 4/1973 | Turnock et al. | 208/245 |
| 4,243,551 A | | 1/1981 | Ward | |
| 4,250,022 A | | 2/1981 | Frame | |
| 4,378,305 A | | 3/1983 | Carlson | |
| 4,481,107 A | | 11/1984 | Urban | |
| 4,675,100 A | | 6/1987 | Maple et al. | |
| 4,824,818 A | | 4/1989 | Bricker et al. | |
| 4,990,242 A | * | 2/1991 | Louie et al. | 208/211 |
| 5,454,933 A | | 10/1995 | Savage et al. | |
| 5,633,216 A | | 5/1997 | Marcilly et al. | |
| 5,726,118 A | | 3/1998 | Ivey et al. | |
| 5,730,860 A | * | 3/1998 | Irvine | 208/213 |
| 5,741,415 A | | 4/1998 | Mazgarov et al. | |

FOREIGN PATENT DOCUMENTS

| | | |
|---|---|---|
| EP | 0 565 324 A1 | 10/1993 |
| GB | 763 625 A | 12/1956 |

OTHER PUBLICATIONS

Asselin et al; Treating Light Refinery Products; The Oil and Gas Journal, vol. 63, No. 1, pp 90–93, Jan. 1965.

* cited by examiner

*Primary Examiner*—Walter D. Griffin
(74) *Attorney, Agent, or Firm*—Oppenheimer Wolff & Donnelly LLP; Louis C. Cullman

(57) ABSTRACT

The desulfurization of petroleum distillates can be carried out by cyclic low-temperature adsorption of oxidized sulfur compounds with activated carbon followed by regeneration of the activated carbon using an organic solvent. The activated carbon used in the process is commercially available and its surface area that ranges from approximately 500 to 2000 $m^2/g$ having a substantial portion of its pores in the range between 10 to 100 Angstroms.

15 Claims, 2 Drawing Sheets

PROCESS FOR DESULFURIZATION OF PETROLEUM DISTILLATES

CROSS REFERENCE TO RELATED APPLICATIONS

This application claims the benefit of United States Provisional Application No. 60/170,416, filed Dec. 13, 1999, which is herein incorporated by reference in its entirety.

FIELD OF THE INVENTION

The present invention relates to a novel process for the removal of sulfur compounds from petroleum distillates by selective adsorption on activated carbon which can be used in petroleum refining for the desulfurization of gasoline, naphtha, kerosene, diesel fuel, fuel oil and other products.

BACKGROUND OF THE INVENTION

The production of sulfur-free petroleum distillates is becoming more and more important due to environmental concerns. In particular, diesel fuel is now regulated all over North America to a maximum sulfur level of 500 ppm (Federal Register, Vol. 64, No. 92, May 13, 1999) for highway diesel engines. In Europe and Japan sulfur levels down to 50 ppm or even lower have been proposed. Currently, catalytic hydrodesulfurization is the technology that is practiced in refineries to reduce diesel sulfur to 500 ppm. The high pressures and temperatures associated with hydrodesulfurization and modifications thereof not only significantly increase the cost, they also have the potential to alter desirable characteristics of distillate fuels. Therefore, there is both a strong economic and technical incentive to develop cost effective techniques for sulfur reduction using very mild conditions (e.g., 20° C. to 75° C. temperature and ambient to very low pressures).

U.S. Pat. No. 5,454,933 teaches a process that uses activated carbon together with catalysts composed of Group VI and Group VIII metals as a polishing desulfurization agent for distillates previously subjected to hydrodesulfurization. U.S. Pat. No. 2,877,176 teaches the use of alkali-doped activated carbon for adsorption of sulfur from distillate fuels followed by washing the carbon with a hot hydrocarbon. However, a complete process for economic sulfur removal by an adsorbent using negligible amounts of activated carbon (impregnating a catalyst within the carbon to create its activation) and other reagents which results in reduced emissions into the environment is not disclosed or described in the prior art.

BRIEF SUMMARY OF THE INVENTION

The present invention relates to a process for desulfurization of petroleum distillates, in particular diesel fuel separated by distillation into a low sulfur and a high sulfur fraction, using cyclic low temperature adsorption of the high sulfur diesel fraction on commercially available activated carbon (catalytically impregnated carbon) followed by a solvent stripping step, a regeneration (solvent-washing) step and a carbon drying step in a closed loop zero emission system. The desulfurized diesel fuel is then blended with the low-sulfur diesel fraction from the primary crude separation (distillation) step to yield the final desulfurized diesel product and a high-sulfur by product.

It is an object of the present invention to reduce total sulfur levels in petroleum distillates to less than approximately 500 ppm.

BRIEF DESCRIPTION OF THE DRAWINGS

FIG. 1 shows the initial process whereby diesel fuel is split into low-sulfur and high-sulfur fractions.

DETAILED DESCRIPTION OF THE INVENTION

Figure 1:
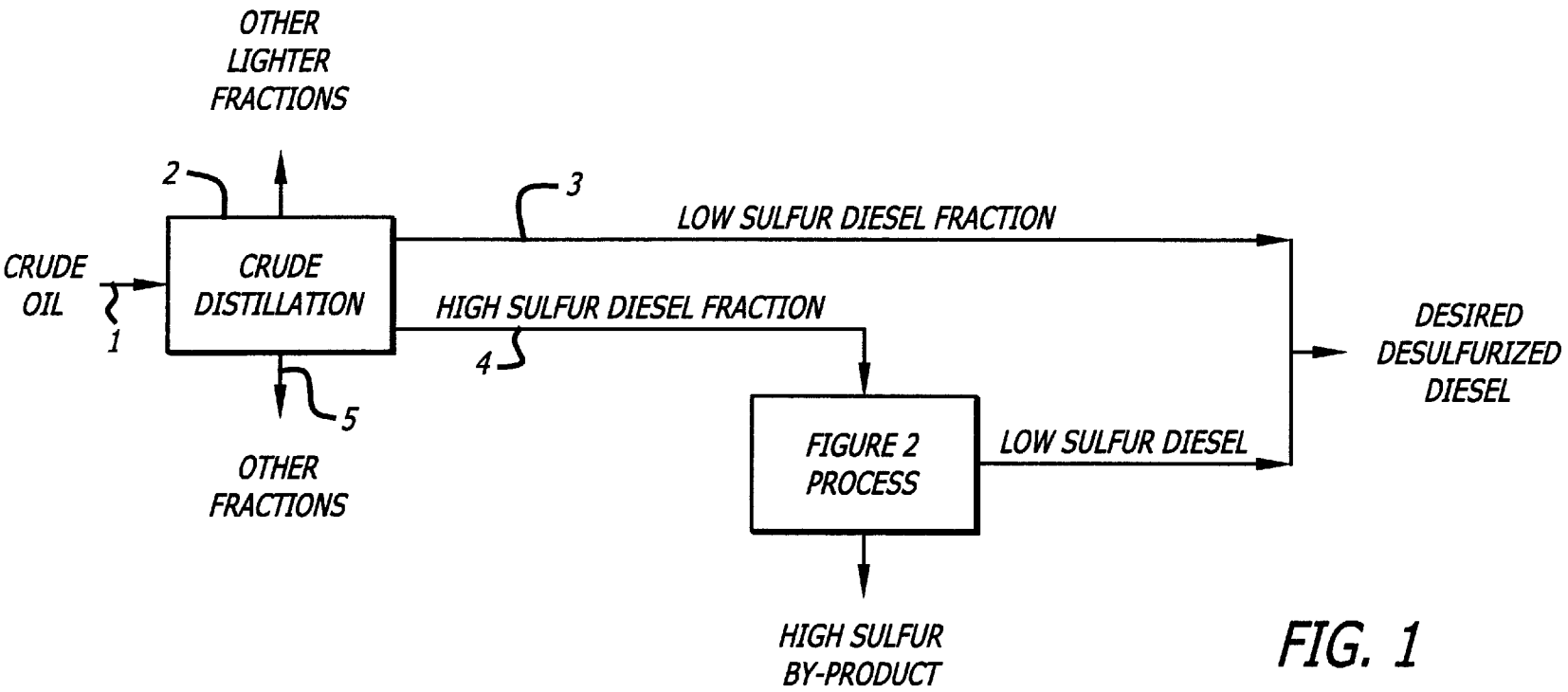
FIG. 1 is a diagrammatic flowchart of the overall process' concept as provided in accordance with the teachings of the present invention. Specifically

In one embodiment of the present invention FIG. 1 crude oil 1 is first subjected to distillation 2 to achieve the various fractions 3, 4, 5 of which diesel 3 is one. Diesel typically ranges from approximately $C_{10}$ to $C_{20}$ hydrocarbons. Approximately 30% of the diesel fraction from $C_{10}$ to $C_{13}$ contains much less sulfur than the heavier fraction ($C_{14}$ to $C_{20}$). The high-sulfur 4 fraction is then subjected to the process shown in FIG. 2.

Figure 2:
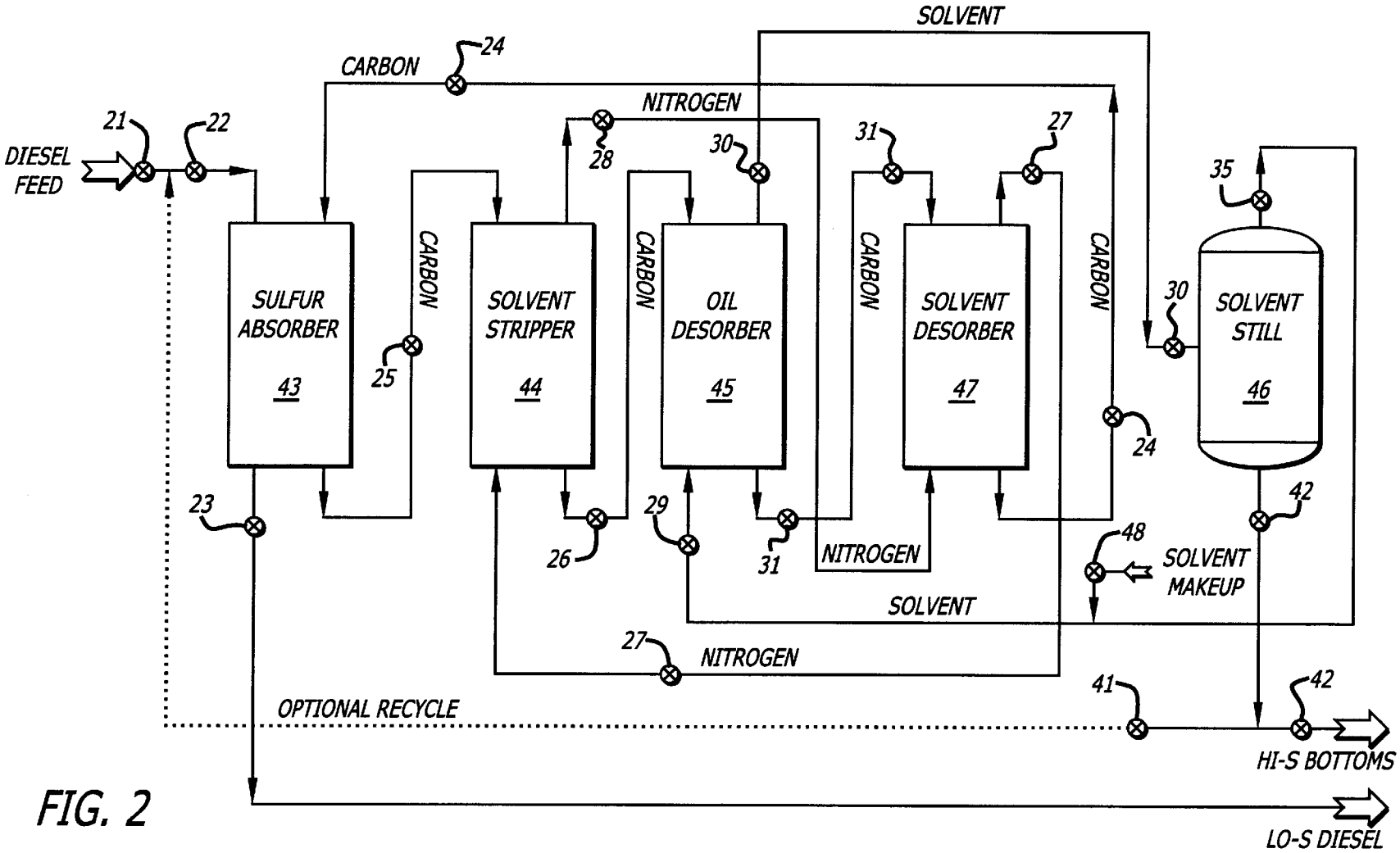
FIG. 2 is a detailed flowchart of the overall desulfurization process of the high-sulfur fraction as provided in accordance with the teaching of the present invention.

The high-sulfur diesel fraction or diesel feed 21 mixes with the high-sulfur bottom recycle 41 as shown in FIG. 2. The combined stream 22 enters the sulfur adsorber 43 either co-currently or counter-currently. The sulfur adsorber 43 consists of a moving-bed of high surface area (between approximately 500 to 1500 $m^2/g$) porous (with most pores in the 10 to 100 Angstrom range) carbon. The diesel fuel is desulfurized and leaves the adsorber 43 as low-sulfur diesel product 23 to be blended with the low sulfur diesel fraction 3 from FIG. 1. The moving carbon stream 25 enters a solvent stripper 44 into which a solvent vapor laden nitrogen stream 27 enters and essentially solvent-free nitrogen stream 28 leaves. The carbon 26 (with oil) moves out of the solvent stripper 44 as stream 26 and enters the oil desorber 45 where it is contacted with liquid solvent and leaving with the desorbed oil as stream 30. The solvent and oil mixture 30 goes to a solvent still 46 and is separated into a high-sulfur bottom stream 42 and a solvent overhead stream 35 that is recycled back to the oil desorber as stream 29. The high-sulfur bottom recycle stream 41 can be recycled to the mix with the diesel as stream 22 to increase the sulfur content of the feed to the sulfur adsorber 43 and reduce the amount of oil carried away in the high-sulfur bottom stream 42. The regenerated carbon leaves the oil desorber as stream 31 and since it contains solvent it enters a solvent desorber 47. The solvent is stripped from the carbon by nitrogen stream 28 and the nitrogen solvent mixture 27 is recirculated back to the solvent stripper 44. The dry regenerated carbon leaves the solvent desorber as stream 24 and is recycled back to the sulfur adsorber 43. The entire process takes place at pressures ranging from approximately 1–5 atmospheres.

Typical temperatures of operation are provided below:

| | |
|---|---|
| Sulfur adsorber 43 | 25—50° C. |
| Solvent stripper 46 | 25—50° C. |
| Oil desorber 45 | 50—100° C. |
| Solvent desorber 47 | 50—110° C. |

Solvents used in conjunction with the teachings of the present invention include organic solvents with boiling points below the boiling point of the petroleum distillate to be desulfurized.

In one embodiment of the present invention, the petroleum distillate is diesel fuel having an initial boiling point of approximately 150° C. Toluene is the preferred solvent for desulfurizing diesel fuel. Other acceptable solvents include, but are not limited to, benzene, chlorinated hydrocarbons, hexane and cyclopentane. However, environmental and toxicity concerns may limit the choice of industrially acceptable solvents. Solvents are selected based upon their ability to remove aromatic components of oxidized sulfur.

The entire process takes place in a closed loop with no emissions. The high-sulfur bottom may carry traces of solvent away and this is made up as stream 48. The modification of crude distillation to split the diesel into two indicated fractions 3 and 4 from FIG. 1 results in a nearly 30% savings in desulfurization because a 30% smaller stream 4 is to be desulfurized. Furthermore, the extremely mild conditions of the desulfurization process present a very cost-effective alternative to hydrodesulfurization.

While the following non-limiting examples utilize diesel fuel as the source of sulfur containing distillates, the present invention can be applied to other distillates. Moreover, the moving-bed is described as the preferred configuration in FIG. 2; however, cyclic fixed-beds, stirred tanks can also be used. The following non-limiting examples will provide the reader, and persons of ordinary skill in the art, a better appreciation and understanding of the present invention.

EXAMPLES

Diesel Fuels Used

The diesel fuels used were gas oil 0.2% S from Saybolt (Diesel #1), L-0, 2–62 premium from Lukoil (Diesel #2), and L-0, 5–62 from Lukoil (Diesel #3). The properties of these fuels as provided by the supplier are shown in Table 1.

Materials Used

The following commercially available carbon sources were used as adsorbents:

A. Carbo-Tech GMBH, Activekohle, Typ D52/4NOx

B. Calgon Mixed BPL 6×16 and PCB 6×16

C. Barneby and Sutcliffe, Type GI, 8×16, Lot #1–31-1T

D. Strem, 06–0050, Lot #135211-S

E. Calgon, Sample #3092–4-3 (high catalytic activity carbon)

F. Calgon, BPL 6×16

G. Calgon, F-400

H. Calgon, Cal 12×40

I. Calgon, CPG 12×40

Sulfur Measurement Instrument

Horiba Sulfur-in-Oil Analyzer SLFA-20.

Petroleum Distillate Samples Used

Diesel #1 was analyzed 10 times using the Horiba analyzer. The average sulfur content was 1353 ppm with a standard deviation of 18 ppm.

The Diesel #2 was analyzed 10 times using the Horiba analyzer. The average sulfur content was 1969 ppm with a standard deviation of 12 ppm.

Diesel #3 was analyzed 10 times using the Horiba analyzer. The average sulfur content was 2847 ppm with a standard deviation of 26 ppm.

Example 1

A quantity of 531.5 g of Diesel #3 measurement of 2850-ppm sulfur was vacuum (at 28" Hg vacuum) distilled to yield 6 fractions. The weight distribution and sulfur content are provided below:

| Fraction # | Weight % | Sulfur (ppm) | Distilled at (° C.) |
|---|---|---|---|
| 1 | 0.34 | 57 | collected from vapor by condensation at −2 |
| 2 | 9.97 | 465 | 172 |
| 3 | 10.47 | 719 | 186 |
| 4 | 10.54 | 1021 | 197 |
| 5 | 6.91 | 1304 | 240 |
| 6 (as measured) | 60.33 | 4201 | Residual Diesel |
| 6 (by subtraction) | 61.82 | — | — |

TABLE 1

Properties of Diesel Fuels

| Experimental Designation | Diesel #1 | Diesel #2 | Diesel #3 |
|---|---|---|---|
| Name | Gasoil 0.2%S | L-0,2-26 Premium | L-0,5-62 |
| Supplier | Saybolt | Lukoil | Lukoil |
| Density (kg/L) | 0.829 | 0.860 | 0.838 |
| Sulfur content (wt %) | 0.13 | 0.19 | 0.50 |
| Cloud point (C) | −9 | −3 | −6 |
| Cold filter Plugging point (C) | −20 | −12 | −14 |
| Flash point (C) | 61 | 65 | 65 |
| Fractional Makeup | | | |
| 1 BP (C) | 165.6 | NA | NA |
| 50% recovered (C) | 252.5 | 279 | 277 |
| 95% recovered (C) | 342.0 | NA | NA |
| 96% recovered (C) | NM | 360 | 354 |
| FBP (C) | 354.5 | NA | NA |

Example 2

Example 1 was repeated using 467.12 g of Diesel #3 that measured at 2850 ppm sulfur. The weight distribution and sulfur contents are provided below.

| Fraction # | Weight % | Sulfur (ppm) | Distilled at (C) |
|---|---|---|---|
| 1 | 0.49 | 230 | collected from vapor by condensation at −2 C. |
| 2 | 10.14 | 548 | 170 |
| 3 | 11.27 | 805 | 183 |
| 4 | 11.32 | 1103 | 195 |
| 5 | 4.21 | 1405 | 240 |
| 6 (as measured) | 61.69 | 4262 | Residual Diesel |
| 6 (by subtraction) | 62.57 | — | — |

Example 3

The residual diesel fractions (#6) from Examples 1 and 2 were combined and subjected to further vacuum distillation into four fractions. The weight distribution and sulfur contents are provided below:

| Fraction # | Weight % | Sulfur (ppm) | Distilled at (C) |
|---|---|---|---|
| 1 | 9.09 | 2004 | 207 |
| 2 | 8.98 | 2310 | 211 |
| 3 | 3.94 | 2475 | 217 |
| 4 | 75.33 | 4780 | Residual Diesel |
| 4 (by subtraction) | 77.99 | — | — |

Example 4

Example 1 was repeated using 261.44 g of Diesel #1 that measured 1353 ppm sulfur. The weight distributions and sulfur contents are provided below:

| Fraction # | Weight % | Sulfur (ppm) | Distilled at (C) |
|---|---|---|---|
| 1 | 0.45 | NM | collected from vapor by condensation at −2 C. |
| 2 | 19.88 | 582 | 164 |
| 3 | 24.17 | 828 | 193 |
| 4 | 20.88 | 1150 | 212 |
| 5 | 2.43 | 1418 | 223 |
| 6 | 29.19 | 2574 | Residual Diesel |

Example 5

Example 1 was repeated using 470.11 g of Diesel #1 that measured 1357 ppm sulfur. Seven fractions were collected. The weight distributions and sulfur contents are provided below.

| Fraction # | Weight % | Sulfur (ppm) | Distilled at (C) |
|---|---|---|---|
| 1 | 0.83 | 379 | collected from vapor by condensation at −2 C. |
| 2 | 10.2 | 518 | 143 |
| 3 | 10.63 | 723 | 152 |
| 4 | 11.97 | 795 | 167 |
| 5 | 9.79 | 846 | 181 |
| 6 | 4.15 | 860 | 194 |
| 7 | 51.65 | 1987 | Residual Diesel |

Example 6

Example 1 was repeated using 818.69 g of Diesel #3 that measured 2850 ppm sulfur. The weight distributions and sulfur contents are provided below:

| Fraction # | Weight % | Sulfur (ppm) | Distilled at (C) |
|---|---|---|---|
| 1 | 0.85 | NM | |
| 2 | 10.94 | 489 | 184 |
| 3 | 8.29 | 622 | 197 |
| 4 | 9.64 | 982 | 203 |
| 5 | 3.77 | 1123 | 207 |
| 6 | 66.50 | 3884 | Residual Diesel |

Example 7

A quantity of 41.72 g of residual diesel (3884 ppm sulfur) from Example 6 was placed in each of 5 different beakers. Ten grams of carbons A, B, C, D and E were mixed into the 5 beakers respectively. The sulfur levels in the free oil was measured and the measurements are shown below:

| | Sulfur remaining (ppm) | |
|---|---|---|
| Carbon | After 4.3 h | After 24.1 h |
| A | — | 3904 |
| B | — | 3071 |

-continued

| | Sulfur remaining (ppm) | |
|---|---|---|
| Carbon | After 4.3 h | After 24.1 h |
| C | — | 3065 |
| D | — | 3134 |
| E | 3572 | 3357 |

Example 8

Unadsorbed residual diesel was decanted from carbons B, C, D, and E of Example 7 and subjected to carbon addition in the same ratio as Example 7. The results of sulfur remaining are shown below:

| | Decanted Residual Diesel | Carbon Added | Sulfur remaining (ppm) | |
|---|---|---|---|---|
| Carbon | (g) | (g) | After 2.5 h | After 23 h |
| B | 23.96 | 5.70 | 2699 | 2552 |
| C | 22.27 | 5.37 | NM | 2553 |
| D | 23.39 | 5.65 | NM | 2586 |
| E | 28.09 | 6.78 | NM | 2792 |

Example 9

Fractions 1 through 5 from Example 6 were combined in a way to yield Batch #1 and Batch #2 with a sulfur measurement of 768 ppm and 694 ppm, respectively. Carbon B was added to each batch in the same oil to carbon ratio as Example 7. The results of the sulfur remaining are shown below:

| | Sulfur remaining (ppm) | |
|---|---|---|
| | After 18 h | After 41 h |
| Batch #1 | 598 | 603 |
| Batch #2 | 480 | 487 |

Example 10

A large sample of Diesel #1 was distilled as in Example 1 to produce 5 fractions and 1584 g of residual diesel. Fractions 1 and 2 were combined to yield 440 g; fractions 3, 4, and 5 were combined to yield 1018 g. The residual diesel measured 1992 ppm sulfur. The 1584 g of residual diesel was placed in a 4 L beaker and approximately 396 g of Carbon B was added. After 72 hours, the sulfur content was reduced to 1330 ppm. The resulting diesel was filtered to yield 1313 g of oil with 271 g of oil retained on the carbon. To the 1313 g of diesel, approximately 326 g of fresh Carbon B was added and the slurry which was left standing for 72 hours. The sulfur content was reduced to 980 ppm. The resulting slurry was filtered and 1096 g of oil was recovered. To this oil, 271 g of Carbon F was added and left standing for an additional 24 hours. The sulfur content was reduced to 797 ppm. This slurry was filtered and 880 g of oil was recovered. To this, 222 g of Carbon C was added and left standing for another 24 hours. The sulfur content was reduced to 635 ppm. The resulting slurry was filtered and yielded 689 g of oil. To this, 70 g of Carbon C and 102 g of Carbon D was added. The sulfur reduced to 531 ppm. This final slurry was filtered to yield 554 g of oil.

Example 11

The combined fractions 3–5 from Example 10 (1018 g) measured 773 ppm sulfur. The combination was placed in a beaker and 252 g of Carbon F was added. After 24 hours the sulfur content had reduced to 612 ppm. The slurry was filtered and 829 g of oil was recovered. To this slurry 206 g of Carbon F was added. After 24 hours the sulfur content had been reduced to 515 ppm. The slurry was filtered and 688 g of oil was recovered. To this 171 g of Carbon D was added. After 24 hours the sulfur content had been reduced to 488 ppm. The slurry was filtered and 570 g of oil was recovered.

Example 12

The combined fractions 1 and 2 from Example 10 (440 g) measured 449 ppm sulfur. This combination was mixed with desulfurized oils from Examples 10 and 11 in the same ratio as the original proportions. Thus 554 g of oil from Example 10 was combined with 378 g of oil from Example 11 and 151 g of combined fractions 1 and 2 to yield desulfurized diesel. The sulfur content of the desulfurized diesel measured at 480 ppm.

Example 13

Saybolt independently analyzed the desulfurized diesel from Example 12. Properties of the original Diesel #1 and desulfurized Diesel #1 are compared in Table 2 which illustrates that other than the reduced sulfur content there were no other significant change in properties.

TABLE 2

Comparison of Properties of Diesel #1 and Desulfurized Diesel #1

| | | | Result | |
|---|---|---|---|---|
| Test | Method | Unit | Diesel #1 | Desulfurized Diesel from Example 13 |
| Specific gravity at 15° C. | ASTM D 4052 | kg/L | 0.8289 | 0.8147 |
| Sulfur | ASTM D 2622 | mass % | 0.13 | 0.054 |
| Flash point | ASTM D 93 | ° C. | 61.0 | 64.0 |
| Cloud point | ASTM D 2500 | ° C. | −9 | −15 |
| Cold filter plugging point | IP 309 | ° C. | −20 | −15 |
| Distillation IBP | | ° C. | 164.5 | 174.0 |
| 10 v/v recovered | | ° C. | 195.0 | 200.0 |
| 20 v/v recovered | | ° C. | 210.0 | 213.5 |
| 30 v/v recovered | | ° C. | 225.5 | 228.5 |
| 40 v/v recovered | | ° C. | 239.0 | 241.5 |
| 50 v/v recovered | | ° C. | 252.5 | 254.5 |
| 60 v/v recovered | | ° C. | 266.5 | 267.5 |
| 70 v/v recovered | | ° C. | 281.0 | 281.5 |
| 80 v/v recovered | | ° C. | 295.5 | 299.0 |
| 90 v/v recovered | | ° C. | 323.5 | 322.5 |
| 95 v/v recovered | | ° C. | 342.0 | 342.0 |
| FBP | | ° C. | 354.0 | 351 |
| Residue | | v/v % | 1.0 | 2.0 |
| Loss | | v/v % | <0.5 | 0.5 |

Example 14

A quantity of 182.4 g of Diesel #2 (sulfur-1973 ppm) was mixed with 45.61 of Carbon D and the mixture was left standing for 24 hours. The sulfur content was reduced to 1339 ppm. The slurry was filtered to yield 155 g of oil. To this, 38.7 g of Carbon D was added. The sulfur content was further reduced to 1034 ppm. The slurry was filtered to yield 132.3 g of oil. To this 33 g Carbon D was added. The sulfur content was reduced to 845 ppm. The slurry was filtered to yield 113 g oil. To this 28 g carbon D was added. The sulfur content was reduced to 704 ppm. The slurry was filtered to yield 95 g oil. To this 23.8 g carbon was added. The sulfur content was reduced to 585 ppm. The slurry was filtered to yield 77 g oil. To this 19 g carbon was added. The sulfur content was reduced to 498 ppm. The slurry yield 67 g of desulfurized diesel measuring 498 ppm sulfur.

Example 15

A quantity of 72 g of spent carbon (with oil) [from Example 10, Carbon C added to 797 ppm sulfur oil] containing an estimated 33 g oil was subjected to Soxhlet extraction using toluene The toluene (with oil extracted) was distilled to separate the oil that measured 31.5 g and had 1261 ppm sulfur. The carbon was dried with nitrogen gas at 120° C. The regenerated carbon was tested for desulfurization efficiency. Forty-one g of regenerated carbon was mixed with 171 g of Diesel #3 containing 2835 ppm sulfur. The sulfur content was reduced to 1949 ppm in 24 hours. The regenerated carbon was thus more efficient than the original carbon.

Example 16

A quantity of 50 mL of Diesel #3 containing 2850 ppm sulfur was mixed with 10 g of carbon G at 22° C. and the sulfur content was monitored as a function of time. The results are shown below:

| Time (h) | Sulfur remaining (ppm) |
|---|---|
| 0.25 | 2594 |
| 0.5 | 2488 |
| 1 | 2292 |
| 2 | 2219 |
| 4 | 2227 |

Example 17

Same as Example 16 except, 20 g of Carbon G was used. The results are shown below:

| Time (h) | Sulfur remaining (ppm) |
|---|---|
| 0.25 | 2033 |
| 0.5 | 1996 |
| 1 | 2002 |
| 2 | 1909 |

Example 18

Same as Example 16 except 50 g Diesel #3 and 30 g of Carbon G was used. The results are shown below:

| Time (h) | Sulfur remaining (ppm) |
|---|---|
| 0.25 | 1555 |
| 0.5 | 1754 |
| 1.0 | 1747 |
| 2.0 | 1822 |
| 4.0 | 1720 |

Example 19

Same as Example 18 except 30 g of Carbon F was used. The results are shown below:

| Time (h) | Sulfur remaining (ppm) |
|---|---|
| 0.08 | 2384 |
| 0.33 | 2298 |
| 0.75 | 2037 |
| 1.0 | 1997 |
| 1.25 | 1835 |
| 3 | 1731 |

Example 20

Same as Example 18 except sulfur was measured quickly. The results are shown below:

| Time (min) | Sulfur remaining (ppm) |
|---|---|
| 2 | 2408 |
| 12 | 2113 |
| 24 | 1882 |

Example 21

Same as Example 18 except 20 g of Carbon H was used. The results are shown below:

| Time (min) | Sulfur remaining (ppm) |
|---|---|
| 5 | 2387 |
| 17 | 2223 |
| 30 | 2169 |
| 60 | 2084 |
| 130 | 1974 |
| 180 | 1976 |
| 285 | 1912 |

Example 22

Same as Example 18 except 20 g of Carbon I was used. The results are shown below:

| Time (min) | Sulfur remaining (ppm) |
|---|---|
| 5 | 2371 |
| 15 | 2259 |
| 40 | 2148 |
| 60 | 2002 |
| 105 | 1965 |
| 210 | 1929 |

Example 23

Same as Example 18 except 30 g of Carbon I was used. The results are shown below:

| Time (min) | Sulfur remaining (ppm) |
|---|---|
| 5 | 2158 |
| 30 | 1880 |
| 60 | 1742 |
| 130 | 1685 |
| 180 | 1660 |
| 240 | 1652 |

Example 24

Same as Example 18 except 30 g of Carbon H was used. The results are shown below:

| Time (min) | Sulfur remaining (ppm) |
|---|---|
| 5 | 2120 |
| 30 | 1780 |
| 60 | 1751 |
| 120 | 1686 |
| 180 | 1643 |
| 240 | 1658 |

Example 25

A quantity of 50 g of Diesel #3 (2850 ppm sulfur) was mixed with approximately 20 g of Carbon G. After 15 minutes of contact with stirring, the slurry was filtered with a recovery of 33 g of diesel. Its sulfur value had dropped to approximately 2201 ppm and 17 g of Diesel #3 remained attached to the wet carbon externally (in between granules) and inside the pores. The original Diesel #3 color was yellow and the diesel recovered was yellow. Fifty (50) g of hexane was poured through the wet carbon and 41 g of hexane wash came through the carbon with 9 g remaining on the carbon. The hexane wash was clear, not yellow, and contained approximately 422 ppm sulfur. Fifty (50) g of toluene was then poured through the wet carbon that had been treated with hexane as above. Forty-three (43) g of toluene wash came through the carbon with 7 g remaining on the carbon. The solvent wash was yellow and contained 291 ppm sulfur. This example illustrates that a more polar and aromatic solvent such as toluene as opposed to hexane recovers chromagenic species from the carbon that actually give the diesel the yellow color, where as hexane is not able to recover these species.

Example 26

Example 25 was repeated except Carbon F was substituted for Carbon G. The diesel recovered from the carbon weighed 36 g. It had 2374 ppm sulfur and its color was yellow. The hexane wash weighed 41 g, it was colorless and had 266 ppm sulfur. The toluene wash weighed 45 g, it was light yellow and it had 218 ppm sulfur.

Example 27

An upflow packed-column was prepared containing about 2200-cc (1238 g) of carbon G. The column was a 2.5-inch× 36-inch high stainless steel tube. External controlled heat was supplied to the column if necessary to control the bed temperature. The diesel flow to the column was set at 17.2 cc/min. A number of diesel fuel samples were tested.

A diesel fuel from a gas station containing 483 ppm sulfur was flowed up through the column at 30° C. Adsorption caused the temperature to rise to 68° C. as the diesel flowed up. Once the adsorption wave went through, the temperature dropped back to 30° C. Four samples of desulfurized diesel were collected in 200 cc batches are shown below:

| | Sulfur (ppm) |
|---|---|
| Batch 1 | 60 |
| Batch 2 | 79 |
| Batch 3 | 129 |
| Batch 4 | 117 |

Thus, the sulfur was reduced from 483 ppm to 60–129 ppm for the first 800 ml of fuel that passed through the column, over about 45 minutes.

Example 28

An upflow column was packed in a similar manner as Example 27. A diesel fuel from a gas station was spiked with dibenzothiophene and thianaphthene to achieve a diesel with a sulfur content of 2863 ppm. This fuel was flowed up at 17.2 cc/min. up through the column in a similar manner as Example 27. Adsorption again caused the temperature to rise to 68° C. and then fall back to 30° C. as the wave passed through the column. Ten samples were collected in 230 cc batches. The sulfur contents of these batches and of the column drain collected are shown below.

| | Sulfur (ppm) |
|---|---|
| Batch 1 | 100 |
| Batch 2 | 347 |
| Batch 3 | 580 |
| Batch 4 | 903 |
| Batch 5 | 1145 |
| Batch 6 | 1390 |
| Batch 7 | 1630 |
| Batch 8 | 1762 |
| Batch 9 | 1930 |
| Batch 10 | 1958 |
| Column Drain | 2731 |

This example demonstrates that the first four batches (690 cc) when combined would have a sulfur content of less that 500 ppm and the last six batches (1610 cc) when combined with a portion of the column drain would have a sulfur content of less than 2000 ppm starting from a diesel containing 2863 ppm sulfur.

Example 29

First four batches from Example 28 were combined and designated as Sample B. The last six batches from Example 28 were combined with 610 ml of column drain and designated as Sample C. Each combination and the feed diesel (designated as Sample A) were sent to Saybolt for measurement of sulfur and other diesel specs. These results are shown in Table 3. These results show that the sulfur reduction was as measured in Example 28. The Cetane index of the product improved, indicating removal of aromatics. The other specs did not change significantly.

TABLE 3

Comparison of Properties of Feed Diesel (Sample A) and Two Product Diesels (Samples B & C) of Example 28

| TEST | ASTM METHOD | RESULT Sample A | Sample B | Sample C |
|---|---|---|---|---|
| Gravity, AP1 at 60° F. | D-1298 | 33.3 | 38.1 | 34.8 |
| Flash Point, Pensky Martens, ° F. | D-93 | 145 | 141 | 147 |
| Cloud Point, ° C./° F. | D-2500 | −12/10 | −13/9 | −11/12 |
| Pour Point, ° C./° F. | D-97 | −21/−6 | −18/0 | −15/5 |
| Sulfur, x-ray, wt. % | D-4294 | 0.278 | 0.045 | 0.185 |
| Water & Sediments (vol. %) | D-2709 | 0.05 | 0.0 | 0.05 |
| Cetane Index | D-4737 | 43.9 | 52.7 | 46.6 |
| Distillation, 1 BP (° F.) | D-86 | 358 | 354 | 357 |
| Rcvd, 10% (° F.) | | 419 | 412 | 418 |
| 50% (° F.) | | 520 | 513 | 517 |
| 90% (° F.) | | 611 | 612 | 612 |
| End Point (° F.) | | 678 | 672 | 674 |
| Recovery, vol. % | | 98.5 | 98.5 | 98.5 |
| Loss, vol. % | | 1.4 | 1.4 | 1.4 |
| | | 0.1 | 0.1 | 0.1 |

Example 30

The sulfided column from Example 27 was regenerated with toluene upflow (13 cc/min) for two hours at 75° C. The sulfur content in the toluene product and column toluene drain indicated a sulfur recovery from the column of 73%. Following the toluene wash, column was purged with nitrogen for two hours at 100° C.

Example 31

The partially regenerated column of Example 30 was tested for recovery of desulfurization efficiency. A diesel sample (Diesel #2, Table 1) containing 1998 ppm sulfur was flowed up through the column at conditions similar to Example 27. Seven 200 cc batches and the column drain were collected and their sulfur content was measured as follows:

| | Sulfur (ppm) |
|---|---|
| Batch 1 | 462 |
| Batch 2 | 558 |
| Batch 3 | 726 |
| Batch 4 | 881 |
| Batch 5 | 962 |
| Batch 6 | 1084 |
| Batch 7 | 1152 |
| Column Drain | 1676 |

Thus, the sulfur content was reduced from 1998 ppm to as low as 462 ppm, indicating partial regeneration of the column with toluene.

Example 32

The column from Example 31 was regenerated again as in Example 30 with toluene followed by a nitrogen purge.

Measurement of sulfur in the toluene effluent and column drain indicated an 86% recovery of the sulfur from the column.

Example 33

The partially regenerated column of Example 32 was tested using a 526 ppm sulfur-containing diesel feed at conditions similar to Example 27. The first 250-ml effluent contained 413-ppm sulfur and the column drain contained 506-ppm sulfur. Examples 31 and 33 indicate that following regenerations, sulfur removal limit is around 500 ppm. This suggested a modification to the regeneration procedure.

Example 34

The column from Example 33 was regenerated as in Example 30 with toluene, however, the nitrogen purge was conducted at a higher temperature of 115° C.

Example 35

The partially regenerated column of Example 34 was again tested using the 526-ppm sulfur containing diesel feed at conditions similar to Example 27. The first 280 ml and the next 125 ml sample effluents showed only 300 ppm sulfur as opposed to 413 ppm in Example 33 and the column drain showed 440 ppm as opposed to 506 ppm sulfur in Example 33. This suggests that the 15° C. higher $N_2$ purge temperature improved the regeneration efficiency of the column.

Example 36

The column of Example 35 was regenerated as in Example 34. The partially regenerated column was tested using a 534-ppm sulfur containing diesel feed, in a manner similar to Example 27, except that the column was maintained at 70° C. as opposed to 30° C. in Example 27. A total of 12 samples of the product and the column drain were collected from the effluent as shown below.

| | Amount (g) | Sulfur (ppm) |
|---|---|---|
| Sample 1 | 178 | 276 |
| Sample 2 | 184 | 294 |
| Sample 3 | 171 | 255 |
| Sample 4 | 173 | 299 |
| Sample 5 | 178 | 316 |
| Sample 6 | 178 | 325 |
| Sample 7 | 177 | 350 |
| Sample 8 | 174 | 357 |
| Sample 9 | 175 | 356 |
| Sample 10 | 186 | 346 |
| Sample 11 | 191 | 338 |
| Sample 12 | 179 | 392 |
| Column Drain | 795 | 480 |

This example shows that the desulfurization efficiency improves at 70° C. since sulfur is consistently removed to less than 350 ppm from 534 ppm for the first seven collections.

Example 37

The column from Example 36 was again regenerated as in Example 35 and subjected to diesel feed containing 485 ppm sulfur in a manner similar to Example 27, except that the temperature was 63° C. and flow was reduced from 17.2 ml/min to 6.3 ml/min. A total of 12 samples of the product and the column drain were collected from the effluent as shown below.

| | Amount (g) | Sulfur (ppm) |
|---|---|---|
| Sample 1 | 129 | 249 |
| Sample 2 | 117 | 277 |
| Sample 3 | 116 | 261 |
| Sample 4 | 121 | 260 |
| Sample 5 | 123 | 263 |
| Sample 6 | 123 | 278 |
| Sample 7 | 120 | 288 |
| Sample 8 | 131 | 322 |
| Sample 9 | 123 | 293 |
| Sample 10 | 120 | 317 |
| Sample 11 | 121 | 284 |
| Sample 12 | 128 | 354 |
| Column Drain | 711 | 468 |

This example shows that a marginal increase in desulfurization efficiency occurs when the flow is lowered from 17.2 ml/min to 6.2 ml/min. The sulfur is reduced from 485 ppm to below 350 ppm in 11 of the first 12 column effluents.

The present invention provides a simple, mild, highly effective and inexpensive desulfurization process which utilizes readily available, durable and inexpensive activated carbons (catalyst impregnated carbons). The desulfurization process performed in accordance with the teachings of the present invention provide the following technical advantages over processes presently known in the art:

1. The initial separation of the crude petroleum distillates into low and high-sulfur fractions limits the volume of distillates to be processed, thus significantly reducing costs.
2. Final oxidized sulfur content in the petroleum distillate product can be regulated by a non-miscible solvent that selectively removes oxidized sulfur aromatic compounds and controlling the number of times the distillate is recycled through fresh regenerated carbon.
3. The desulfurization process is mild and effective.
4. Selective regeneration of the carbon can be accomplished by using different solvents.
5. Diesel fuel quality is not adversely effected.
6. A very high-sulfur, low volume bottom product is produced by repeated exposure to the fresh regenerated carbon, thus increasing fuel yields and decreasing waste.

It will be apparent to one of ordinary skill in the art that many changes and modifications can be made in the invention without departing from the spirit or scope of the appended claims.

What is claimed is:

1. A process for removing sulfur compounds from petroleum compounds comprising:

(a) separating said petroleum compounds into a first low-sulfur fraction and a first high-sulfur fraction;

(b) reacting said first high-sulfur fraction with at least one oxidizing agent;

(c) contacting a product of step (b) with at least one activated carbon capable of adsorbing said sulfur compounds thereby forming a second low-sulfur fraction and a second high-sulfur fraction;

(d) regenerating said at least one activated carbon in a closed loop system with at least one solvent and at least one gas; and (e) recovering said petroleum compounds having said sulfur compounds removed therefrom.

2. The process of claim 1 further comprising:

contacting said second high-sulfur fraction with said at least one activated carbon; and recycling said second high-sulfur fraction repeatedly through said at least one activated carbon until said sulfur content level in said petroleum compound is less than approximately 500 ppm.

3. The process of claim 1 wherein said solvents are selected from the group consisting of toluene, benzene, chlorinated hydrocarbons, hexane, and cyclopentane.

4. The process of claim 1 wherein said gas is nitrogen.

5. The process of claim 1 further comprising maintaining said process at a temperature of at least 20° C.

6. The process of claim 1 further comprising maintaining said process at a temperature within the range of approximately 20° C. to 150° C.

7. The process of claim 1 further comprising maintaining said process at a pressure within the range of approximately 1 to 5 atmospheres.

8. The process of claim 1 wherein said petroleum compound is selected from the group consisting of gasoline, naphtha, kerosene, diesel fuel, fuel oil, and crude oil.

9. The process of claim 1 wherein said oxidizing agents are selected from the group consisting of air, oxygen, and hydrogen peroxide.

10. The process of claim 1 wherein said activated carbons are arranged in a configuration selected from the group consisting of moving-beds, fixed-beds, cyclic fixed-beds, and stirred tanks.

11. The process of claim 1 wherein said activated carbons have a surface area of at least 500 $m^2/g$.

12. The process of claim 1 wherein said activated carbons have a surface area of approximately between 500 to 2000 $m^2/g$.

13. The process of claim 1 wherein said activated carbons have a pore size ranging between 10 to 100 Angstroms.

14. A process for removing sulfur compounds from petroleum compounds comprising:

(a) separating said petroleum compounds into a first low-sulfur fraction and a first high-sulfur fraction;

(b) reacting said first high-sulfur fraction with oxidizing agents;

(c) contacting a product of step (b) with activated carbons capable of adsorbing said sulfur compounds thereby forming a second low-sulfur fraction and a second high-sulfur fraction;

(d) eluting said adsorbed sulfur compounds from said activated carbons with solvents;

(e) removing said adsorbed sulfur compounds from said solvents (f) applying a gas to said activated carbons; and wherein steps d, e and f constitute an activated carbon regeneration process occurring in a closed loop system.

15. The process of claim 14 further comprising contacting said solvents of step (d) having adsorbed sulfur compounds with said activated carbons.

* * * * *